US007237391B1

(12) United States Patent
Shivers, III

(10) Patent No.: US 7,237,391 B1
(45) Date of Patent: Jul. 3, 2007

(54) METHOD FOR PROCESSING AND TRANSPORTING COMPRESSED NATURAL GAS

(75) Inventor: Robert Magee Shivers, III, Houston, TX (US)

(73) Assignee: ATP Oil & Gas Corporation, Houston, TX (US)

( * ) Notice: Subject to any disclaimer, the term of this patent is extended or adjusted under 35 U.S.C. 154(b) by 451 days.

(21) Appl. No.: 10/861,971

(22) Filed: Jun. 4, 2004

Related U.S. Application Data

(60) Provisional application No. 60/485,973, filed on Jul. 10, 2003.

(51) Int. Cl.
*F17C 13/08* (2006.01)
*F25J 3/00* (2006.01)

(52) U.S. Cl. ..... 62/53.2; 62/45.1; 62/50.1; 62/618; 62/48.1; 62/50.2

(58) Field of Classification Search ..... 62/48.1, 62/50.2, 53.2, 45.1, 50.1, 618; 114/74
See application file for complete search history.

(56) References Cited

U.S. PATENT DOCUMENTS

| | | | | |
|---|---|---|---|---|
| 3,232,725 A | | 2/1966 | Secord et al. | 48/190 |
| 3,830,180 A | * | 8/1974 | Bolton | 114/74 A |
| 5,150,812 A | * | 9/1992 | Adams | 220/589 |
| 6,085,528 A | * | 7/2000 | Woodall et al. | 62/45.1 |
| 6,089,028 A | | 7/2000 | Bowen et al. | 62/50.2 |
| 6,237,347 B1 | | 5/2001 | Rigby et al. | 62/41.8 |
| 6,378,330 B1 | | 4/2002 | Minta et al. | 62/613 |
| 6,460,721 B2 | | 10/2002 | Bowen et al. | 220/586 |
| 6,564,580 B2 | * | 5/2003 | Bowen et al. | 62/623 |

FOREIGN PATENT DOCUMENTS

WO WO/98/59085 6/1998

(Continued)

OTHER PUBLICATIONS

Troner, Alan, (Nov. 2001) "New Energy Technologies in the Natural Gas Sectors: A policy framework for Japan, Technology and Liquefied Natural Gas: Evolution of Markets", James A. Baker III Institute for Public Policy of Rice University, pp. 1-20.*

(Continued)

*Primary Examiner*—Cheryl Tyler
*Assistant Examiner*—John Pettitt
(74) *Attorney, Agent, or Firm*—Buskop Law Group, P.C.; Wendy Buskop

(57) ABSTRACT

A method for processing and transporting compressed natural gas by a floating vessel with a power plant entails obtaining pressurized high-energy content gas, separating the pressurized product stream into saturated gas and liquids, and removing impurities from the saturated gas. Water is removed from the gas forming a dry pressurized gas. The dry pressurized gas is cooled forming a two-phase gas. The gas is loaded into a storage element located on a floating vessel, while the liquids are loaded into the storage element forming a mixture. The floating vessel transports the storage modules and elements to a desired location at a lower cost than comparable submarine pipeline transport costs for distances of less than about 2500 nautical miles while utilizing the vapor phase during transit to power the floating vessel.

18 Claims, 4 Drawing Sheets

FOREIGN PATENT DOCUMENTS

| | | |
|---|---|---|
| WO | WO/99/32837 | 6/1998 |
| WO | WO/00/23756 | 10/1999 |
| WO | WO/00/36332 | 12/1999 |
| WO | WO/00/57102 | 2/2000 |
| WO | WO/01/92778 | 5/2001 |

OTHER PUBLICATIONS

Ladkany, S. G. "Composite aluminum-fiberglass Epoxy pressure vessels for transportation of LNG at Intermediate Temperature", Advances in cryogenic materials, vol. 28, Proceedings of the 4th international cryogenic materials conference. Aug. 10-14, 1981. Adn. Diego Calif.*

Bennett, C. P. "M-3 Marine Transportation of LNG at Intermediate Temperature". pp. 751-756.

Broeker, Roger J. *American Gas Journal*. "CNG and MLG—New Natural Gas Transportation". *American Gas Journal*, Jul. 1969.

Faridany, Edward K.M., Roger C. Ffooks, and Robin B. Meikle. "A Pressure LNG System". European Offshore Petroleum conference and Exhibition, pp. 245-254.

Faridany E. K., et al. "The Ocean Phoenix Pressure—LNG System," pp. 267-280.

Fluggen E. and Dr. Ing. H. Backhaus. "Pressurised LNG—and the Utilisation of Small Gas Fields," pp. 195-204.

* cited by examiner

FIGURE 3
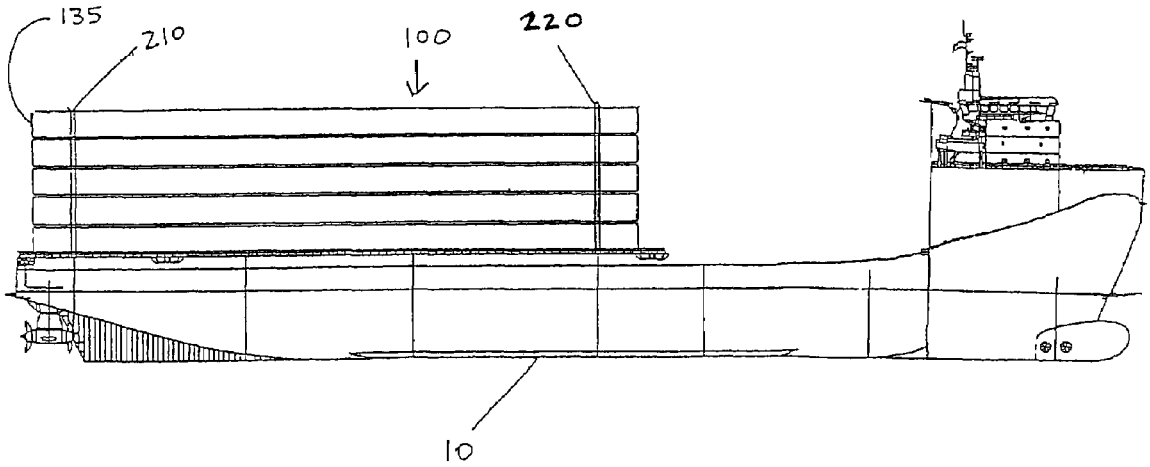
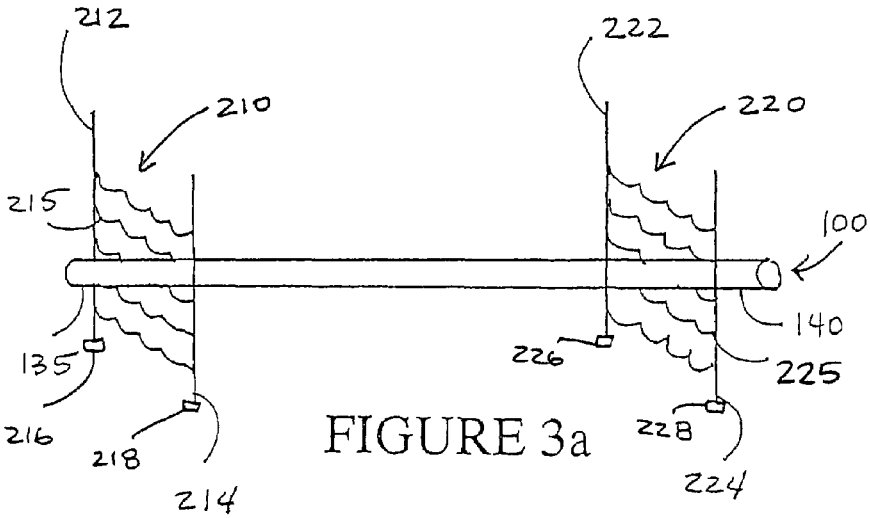
FIGURE 3a

METHOD FOR PROCESSING AND TRANSPORTING COMPRESSED NATURAL GAS

The present application claims priority to now abandoned U.S. Provisional Patent Application Ser. No. 60/485,973 filed on Jul. 10, 2003.

FIELD

The present embodiments relate to methods for processing and transporting compressed natural gas.

BACKGROUND

The current art teaches three known methods of transporting natural gas across bodies of water. A first method is by way of subsea pipeline. A second method is by way of ship transport as liquefied natural gas (LNG). A third method is by way of barge, or above deck on a ship, as compressed natural gas (CNG). Each method has inherent advantages and disadvantages.

Subsea pipeline technology is well known for water depths of less than 1000 feet. The cost of deep water subsea pipelines is very high and methods of repairing and maintaining deep water subsea pipelines are just being pioneered. Transport by subsea pipeline is often not a viable option when crossing bodies of water exceeding 1000 feet in depth. A further disadvantage of subsea pipelines is that, once laid, it is impractical to relocate them.

Liquefied natural gas systems, or LNG systems, require natural gas to be liquefied. This process greatly increases the fuel's density, thereby allowing relatively few number of ships to transport large volumes of natural gas over long distances. An LNG system requires a large investment for liquefaction facilities at the shipping point and for re-gasification facilities at the delivery point. In many cases, the capital cost of constructing LNG facilities is too high to make LNG a viable option. In other instances, the political risk at the delivery and/or supply point may make expensive LNG facilities unacceptable. A further disadvantage of LNG is that even on short routes, where only one or two LNG ships are required, and the transportation economics are still burdened by the high cost of full shore facilities. The shortcoming of a LNG transport system is the high cost of the shore facilities that, on short distance routes, becomes an overwhelming portion of the capital cost.

Natural gas prices are currently increasing rapidly due to an inability to meet demand. Unfortunately, the LNG import terminals existing in the United States are presently operating at capacity. New import terminals of the type currently used in the United States cost hundreds of millions of dollars to build. Moreover, it is very difficult and expensive to find and acquire permissible sites for such facilities. Besides the space needed for the import tanks, pumps, vaporizers, etc., large impoundment safety areas must also be provided around all above-ground LNG storage and handling vessels and equipment. LNG import facilities also consume large amounts of fuel gas and/or electrical energy for pumping the LNG from storage and vaporizing the material for delivery to gas distribution systems.

Compressed natural gas, or CNG, can be transported by way of barge or above deck on a ship. For the method to work, the CNG is cooled to a temperature around −75 degrees Fahrenheit at a pressure of around 1150 psi. The CNG is placed into pressure vessels contained within an insulated cargo hold of a ship. Cargo refrigeration facilities are not usually provided aboard the ship. A disadvantage of this system is the requirement for connecting and disconnecting the barges into the shuttles that takes time and reduces efficiency. Further disadvantages include the limited seaworthiness of the multi-barge shuttles and the complicated mating systems that adversely affect reliability and increase costs. In addition, barges systems are unreliable in heavy seas. Finally, current CNG systems have the problem of dealing with the inevitable expansion of gas in a safe manner as the gas warms during transport.

The amount of equipment and the complexity of the inter-connection of the manifolding and valving system in the barge gas transportation system bears a direct relation to the number of individual cylinders carried onboard the barge. Accordingly, a significant expense associated with the manifolding and valving connecting the gas cylinders. Thus, the need has arisen to find a storage system for compressed gas that can both contain larger quantities of compressed gas and simplify the system of complex manifolds and valves.

A need exists to transfer compressed natural gas across heavy seas to locations greater than 500 nautical miles.

A need exists for a system that can solve the concerns of the inevitable expansion of gas experienced as CNG warms during transport.

SUMMARY

A method for processing and transporting compressed natural gas by a floating vessel with a power plant entails obtaining pressurized high-energy content gas and separating the pressurized product stream into saturated gas, a natural gas liquid, and a condensate. The method continues by removing impurities from the saturated gas to create a decontaminated saturated gas; dehydrating the decontaminated saturated gas to remove water forming a dry pressurized gas; and cooling the dry pressurized gas forming a two-phase gas having a vapor phase and a liquid phase.

The two-phase gas is loaded into a double-walled storage element located on a floating vessel. The condensate and the natural gas liquid from the separator are also loaded into the double-walled storage element forming a mixture. A pressure of about 800 psi to about 1200 psi is maintained in the double-walled storage element. The method ends by moving the floating vessel to a desired location at a lower cost than comparable submarine pipeline transport costs for distances of less than about 2500 nautical miles while utilizing the vapor phase during transit to power the floating vessel.

BRIEF DESCRIPTION OF THE DRAWINGS

The present embodiments will be explained in greater detail with reference to the appended Figures, in which:

FIG. 3 depicts a side view of the storage module located on a floating vessel.

FIG. 3*a* depicts a perspective view of one rack and two stanchions of the storage module.

The present embodiments are detailed below with reference to the listed Figures.

DETAILED DESCRIPTION OF THE PREFERRED EMBODIMENTS

Before explaining the present embodiments in detail, it is to be understood that the embodiments are not limited to the particular embodiments herein and it can be practiced or carried out in various ways.

Embodied herein is a method for processing and transporting compressed natural gas.

Figure 1:
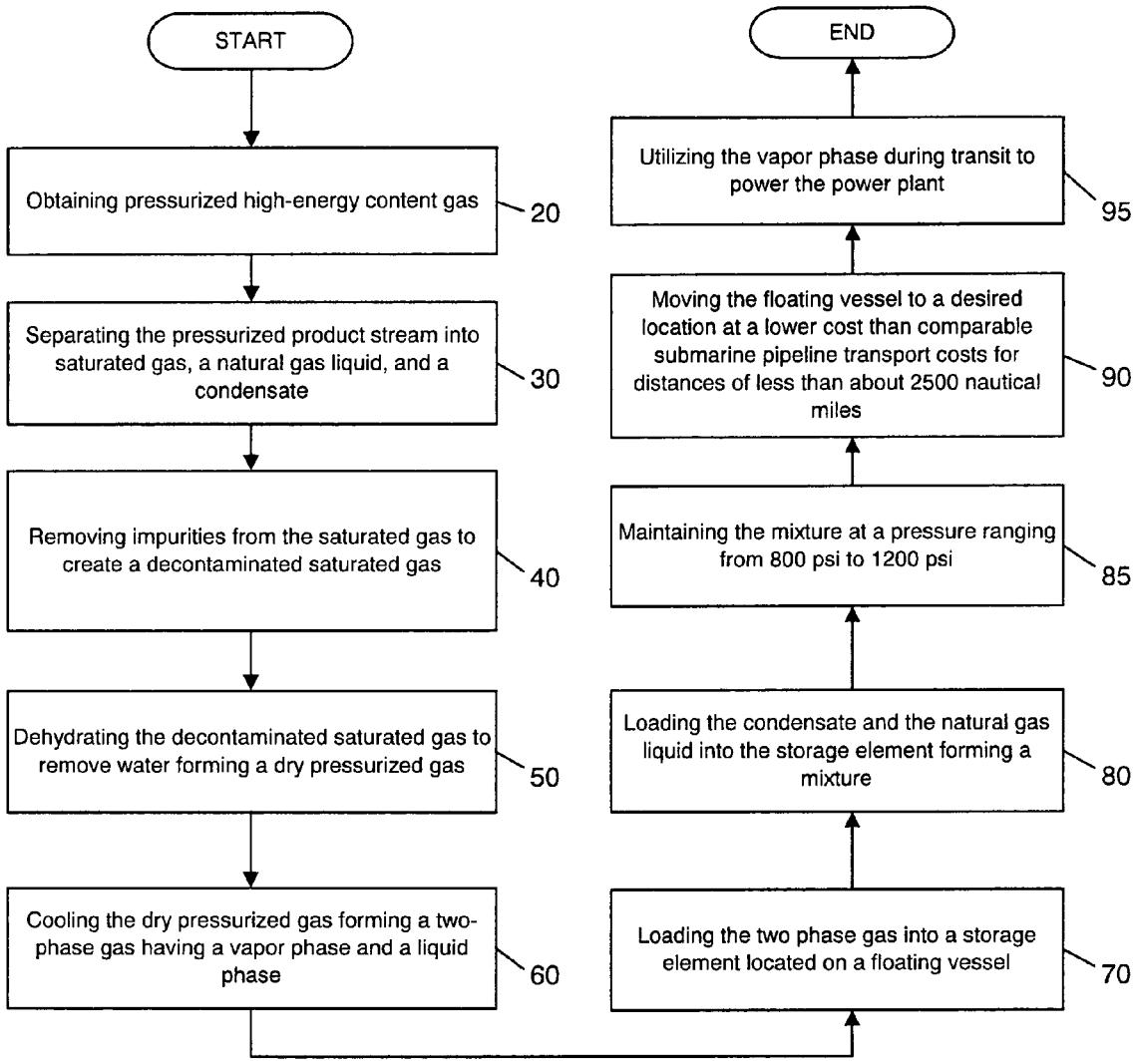
FIG. 1 is a schematic of an embodiment of the method for processing and transporting compressed natural gas by a floating vessel.

With reference to the figures, FIG. 1 is a schematic of an embodiment of the method. The method for processing and transporting compressed natural gas by a floating vessel begins by obtaining pressurized high-energy content gas (20) and separating the pressurized product stream into saturated gas, a natural gas liquid, and a condensate (30). The method continues by removing impurities from the saturated gas to create a decontaminated saturated gas (40), dehydrating the decontaminated saturated gas to remove water forming a dry pressurized gas (50), and cooling the dry pressurized gas forming a two-phase gas having a vapor phase and a liquid phase (60).

The two-phase gas is then loaded into a storage element (70) followed by the condensate and the natural gas liquid being loaded into the storage element forming a mixture (80). In some cases, the condensate can be removed to a separate storage container. In a preferred embodiment, the double-walled storage element is located on the floating vessel. In the alternative, the two-phase gas, the natural gas liquid, and the condensate is loaded into the double-walled storage element located on land, then loaded on to the floating vessel.

The pressure of the mixture is maintained within the storage element at a pressure ranging from about 800 psi to about 1200 psi (85).

As shown in FIG. 1, the final step of the method is moving the floating vessel with the loaded double-walled storage element to a desired location. This step of the method is done at a lower cost than comparable submarine pipeline transport costs for distances of less than about 2500 nautical miles (90). The lower cost is up to 50% less than comparable submarine pipeline costs or conventional LNG costs.

As the mixture in the double-walled storage element warms during transit, vapor gas is formed. The vapor phase is used to power the power plant (95). The vapor gas is a high pressure boil-off gas that is blended with diesel fuel to power the power plant.

A method for expediting unloading of compressed natural gas entails using the storage elements to allow an inventory to be created on the floating vessel. The inventory can then be offloaded in numerous ways that are more time efficient than comparable off-loading methods of compressed natural gas. The compressed natural gas can be unloaded by a direct offload. In a direct offload, the compressed natural gas is allowed to warm creating a vapor phase that unloads directly from the storage element on the floating vessel to the offload destination. At the end of the off-loading method, a "heel" volume of gas remains in the storage element. The remaining gas is blended with diesel fuel to power the power plant in the floating vessel for the return trip.

A second method for offloading compressed natural gas from the floating vessel involves pumping the compressed natural gas liquid directly from the storage elements. Like the previous method, a quantity remains in the storage element for use in powering the floating vessel for the return trip.

Another method for offloading compressed natural gas from a floating vessel is by isobaric displacement. The compressed natural gas in the storage elements is at a temperature of around −100 degrees Fahrenheit and a pressure around 1000 psi. The contents of the storage element are displaced with natural gas from the offloading spot. The displacement gas is at ambient temperature and has a pressure around 1000 psi and is eventually removed from the storage element by placing it on the suction of a compressor. As the gas is removed from the storage elements, the pressure lowers causing the temperature to lower since the volume of the storage elements are fixed. The storage elements are, therefore, cooled. A "heel" volume of the gas is left in the storage element to power the floating vessel with the vapor phase created by the natural warming of the storage element on the return trip. When the original contents of the storage elements are displaced, they are either placed in storage or warmed and placed into the pipeline. The storage can be numerous vessels for holding compressed gas or even a salt dome.

The three described offloading methods can be used with compressed natural gas loaded in storage elements or as a collection of storage elements in a storage module.

Figure 2:
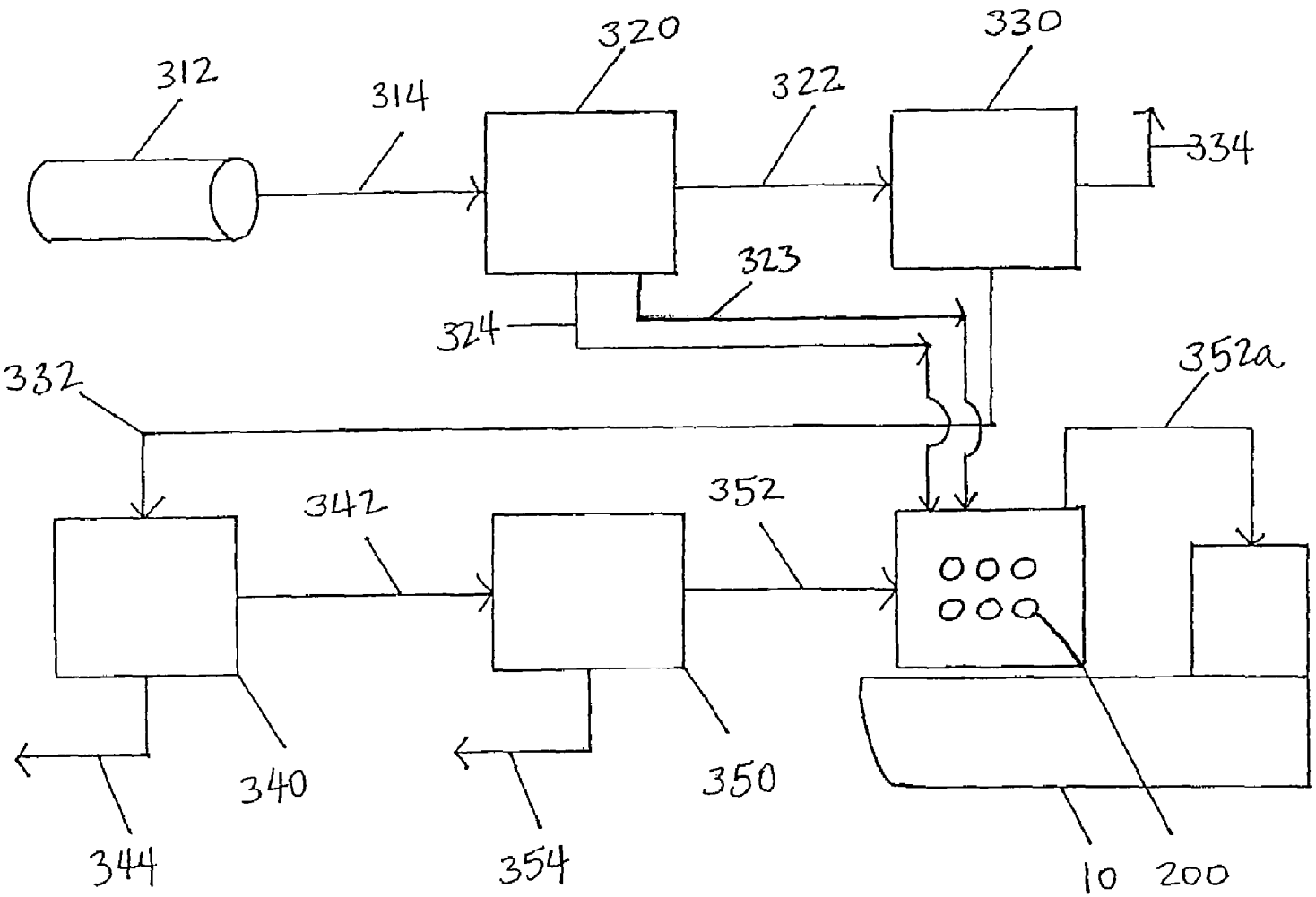
FIG. 2 is a schematic of the system for processing and transporting compressed natural gas.

The components utilized in the embodied methods can be considered as a system. The system is shown in FIG. 2. The system comprises a separator (320) for receiving pressurized high-energy content gas (314) from a pipeline (312). The separator separates the pressurized high-energy content gas (314) stream into saturated gas (322), natural gas liquid (323), and condensate (324). An example of a separator is a three-phase separation vessel.

The system involves a decontamination unit (330) connected to the separator (320) for receiving the saturated gas (322). The decontamination unit (330) removes impurities (334) from the saturated gas (322) to form decontaminated saturated gas (332). The types of impurities removed from the saturated gas (322) are CO2, mercury, H2S, and combinations thereof. Examples of decontamination units include an amine contactor, a catalytic bed, a scrubber vessel, or combinations thereof.

As shown in FIG. 2, the system includes a dehydration unit (340). The dehydration unit (340) is connected to the decontamination unit (330) and receives the decontaminated saturated gas (332). The dehydration unit (340) removes the water (344), in the form of water vapor, to create dry pressurized gas (342). Examples of dehydration units (340) usable in the embodied systems include dry bed adsorption units, glycol contact towers, molecular membrane units, or combinations thereof.

The system then includes a chiller (350) connected to the dehydration unit (340). The chiller receives the dry pressurized gas (342) and cools the dry pressurized gas (342) from ambient temperature to a temperature ranging from about −80 degrees Fahrenheit to about −120 degrees Fahrenheit forming a two-phase gas having a vapor phase (352) and a liquid phase (354). Examples of chillers (350) are a single-stage mixed refrigerant process and a two-stage cascade system. The chiller (350) is also used to sub-cool the dry pressurized gas (342) to delay the formation of the vapor phase (352).

Continuing in FIG. 2, the system uses at least one storage module (200) located on the floating vessel (10). The storage module (200) is connected to the chiller (350) and the separator (320) and receives the vapor phase (352) of the two-phase gas, the natural gas liquid (323), and the condensate (324). The storage module (200) maintains the vapor phase (352) of the two-phase gas, the natural gas liquid, and the condensate at a pressure ranging from 800 psi and 1200 psi.

The system finally includes a floating vessel (10). The floating vessel (10) is adapted to transport at least one storage module (200) a distance of ranging from 500 nautical miles to 2500 nautical miles. The vapor phase (352*a*) that is formed due to the warming of the two-phase gas during transport is used to power the floating vessel (10). Using the vapor phase from the two-phase gas to power the floating vessel both alleviates the environmental concerns of the gas being vented to the atmosphere and also lowers the cost.

As shown in FIG. 3 and FIG. 3*a*, the storage module is made of a first structural frame (210) with two stanchions (212 and 214) and a second structural frame (220) with two stanchions (222 and 224). Each stanchion has a skid shoe (216, 218, 226, and 228). The skid shoe mountings allow the module to be transported from land to a floating vessel (10) easily. A first rack (215) connects the first and second stanchions (210 and 211). A second rack (225) connects the third and fourth stanchions (212 and 213).

Figure 4A:
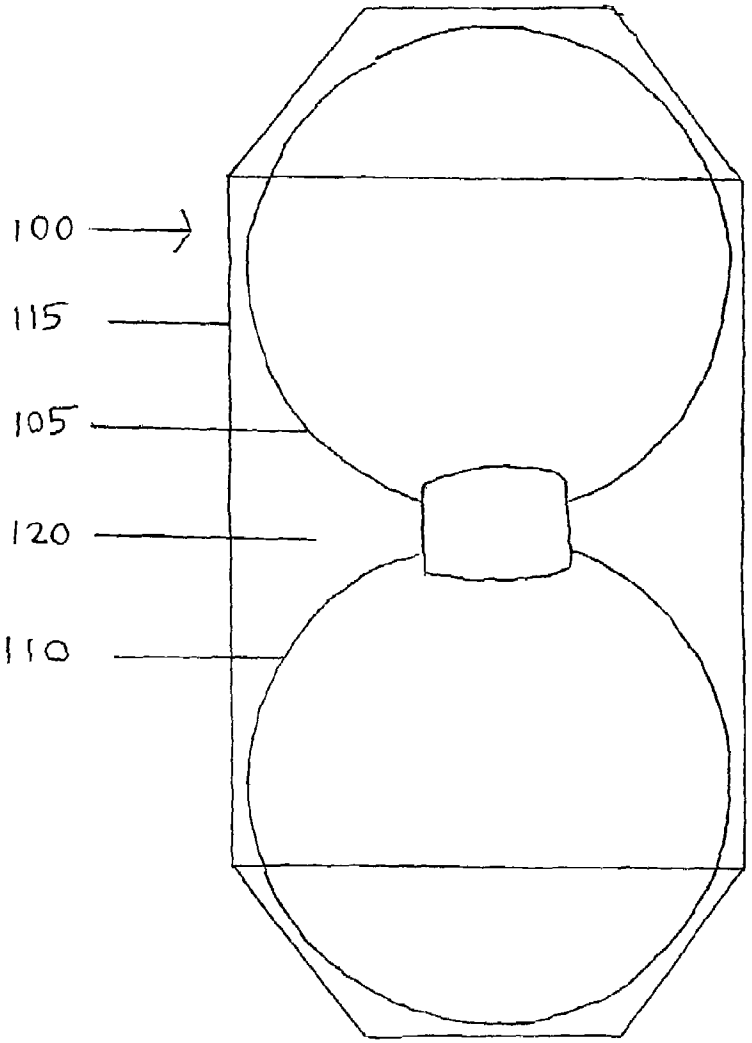
FIG. 4*a* depicts the spherical shape embodiment of the storage element.
Figure 4:
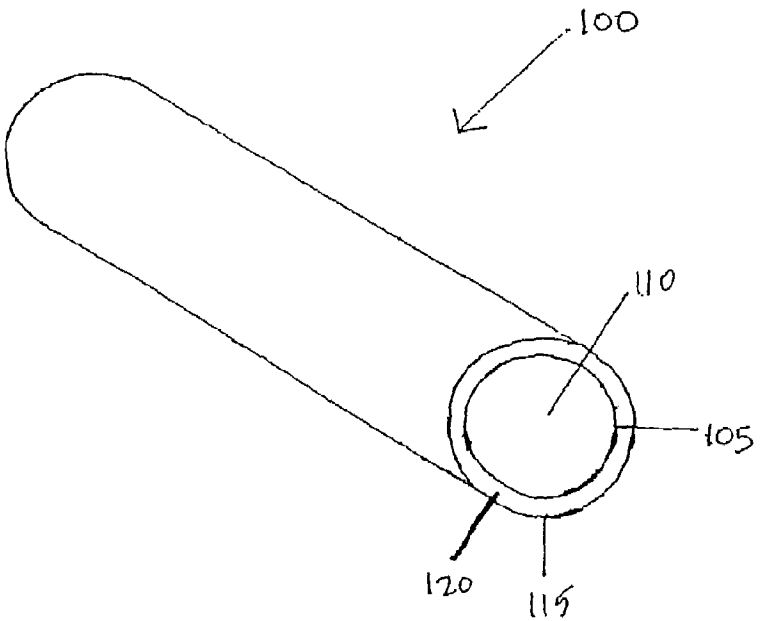
FIG. 4 depicts the cylindrical shape embodiment of the storage element.

Each storage module holds one or more storage elements (100). The storage elements have a first end (135) and a second end (140). An individual storage element (100) is shown in FIG. 4. The storage element (100) has an inner wall (105) forming a cavity (110), an outer wall (115), and an insulation layer (120) located between the inner wall (105) and outer wall (115). The cavity (110) is designed to hold compressed cooled natural gas, natural gas liquid, and condensate.

Returning to FIG. 3 and FIG. 3*a*, the first end (135) of the storage element is supported in the first rack (215) and the second end (140) is supported in the second rack (225).

The storage module supports between three and fifteen storage elements. The weight of the storage module when loaded with at least one empty storage element ranges from about 5000 short tons to about 8000 short tons.

The structural frames (210 and 220) can support up to five racks between the stanchions. The structural frames (210 and 220) can be located on a floating vessel (10) with a hull wherein the structural frames (210 and 220) extend beyond the hull and are supportable on at least two jetties.

The first and second racks can support up to five storage elements. The rack can further include a plate supported by a plurality of ridges for removably holding the storage element. The rack has an anchor for fixing the storage element at the first end. The second end, or unanchored end, is adapted to travel to accommodate thermal strain.

The storage element's empty weight ranges from 350 short tons to 700 short tons when loaded. Each storage element can have a length up to about 350 feet.

As shown in FIG. 4, the storage elements have the outer wall (115) thinner than the inner wall (105), since the outer wall (115) is not designed to be load bearing. The outer wall (115) can be steel, stainless steel, aluminum, thermoplastic, fiberglass, or combinations thereof. Stainless steel is preferred since stainless steel reduces radiant heat transfer and is fire-resistant and corrosion-resistant.

The construction material for the inner wall (105) is a high-strength steel alloy, such as a nickel-steel alloy. The construction material for the inner wall could be a basalt-based fiber pipe.

The shape of the storage element can either be cylindrical or spherical. The cylindrical shape, as shown in FIG. 4, is a preferred embodiment. The inner wall (105) has a diameter ranging from 8 feet to 15 feet with a preferred range from 10 feet to 12 feet. The outer wall (115) has a diameter that is up to four feet larger in diameter than the inner wall. FIG. 4*a* depicts the spherical embodiment of the storage element.

For the spherical shape, the inner wall has a diameter ranging from 30 feet to 40 feet. The outer wall has diameter that is up to three feet larger in diameter than the inner wall.

The insulating layer is either perlite or a vacuum.

While these embodiments have been described with emphasis on the preferred embodiments, it should be understood that within the scope of the appended claims these embodiments might be practiced or carried out in various ways other than as specifically described herein.

What is claimed is:

1. A method for processing and transporting compressed natural gas by a floating vessel with a power plant, wherein the method comprises the steps:

a. obtaining pressurized high-energy content vapor gas at a first pressure;

b. separating the pressurized high-energy content gas into saturated gas, a natural gas liquid, and a condensate;

c. removing impurities from the saturated gas to create a decontaminated saturated gas;

d. dehydrating the decontaminated saturated gas to remove water forming a dry pressurized gas;

e. cooling the dry pressurized gas forming a two-phase gas comprising a vapor phase and a liquid phase;

f. loading the two-phase gas into a storage element located on a floating vessel, wherein the storage element comprises:

i. a high strength steel alloy inner wall for load bearing purposes forming a cavity;

ii. a stainless steel alloy outer wall for non load bearing purposes; and iii. an insulation layer of perlite disposed between the inner and outer wall, and wherein the cavity is adapted to hold the vapor phase and the liquid phase;

g. loading the natural gas liquid and the condensate into the storage element forming a mixture;

h. maintaining the mixture at the first pressure ranging from 800 psi to 1200 psi; and moving the floating vessel to a desired location at a lower cost than comparable submarine pipeline transport costs for distances of less than about 2500 nautical miles while utilizing the vapor phase during transit to power a power plant; and discharging the natural gas at the first pressure.

2. The method of claim 1, wherein the step of moving the floating vessel comprises a warming the vapor phase during transit forming a high pressure boil-off gas, wherein the high pressure boil-off gas is blended with diesel fuel to power the power plant.

3. The method of claim 1, wherein the step of removing impurities comprises removing a member of the group consisting of carbon dioxide, mercury, hydrogen sulfide, and combinations thereof.

4. The method of claim 1, further comprising the step of loading the two-phase gas into the storage element, wherein the storage element is disposed on land and then loaded on the floating vessel.

5. The method of claim 1, wherein the outer wall is thinner than the inner wall.

6. The method of claim 1, wherein the inner wall is a high-strength steel alloy or a basalt-based fiber pipe.

7. The method of claim 6, wherein the high-strength steel alloy is a nickel-steel alloy.

8. The method of claim 1, wherein the outer wall is steel, stainless steel, an aluminum, a thermoplastic, a fiberglass, or combinations thereof.

9. The method of claim 1, wherein the storage element is cylindrical.

10. The method of claim 9, wherein the inner wall comprises a diameter ranging from 8 feet to 15 feet.

11. The method of claim 10, wherein the inner wall comprises a diameter ranging from 10 feet to 12 feet.

12. The method of claim 9, wherein the outer wall comprises a diameter that is up to four feet larger in diameter than the inner wall.

13. The method of claim 1, wherein the storage element is spherical.

14. The method of claim 13, wherein the inner wall comprises a diameter ranging from 30 feet to 40 feet.

15. The method of claim 14, wherein the outer wall comprises a diameter that is up to three feet larger in diameter than the inner wall.

16. The method of claim 1, wherein the insulating layer is a vacuum.

17. The method of claim 1, wherein the mixture is 90% to 99% liquid phase gas.

18. The method of claim 1, wherein the two-phase gas is cooled from ambient temperature to a temperature ranging from −80 degrees Fahrenheit to −120 degrees Fahrenheit.

* * * * *